United States Patent [19]

Pirc

[11] Patent Number: 4,717,469

[45] Date of Patent: Jan. 5, 1988

[54] DEVICE FOR SCAVENGING METAL FROM EARTH DEPOSITS

[76] Inventor: Anton Pirc, 3201 Wagner Place, Santa Rosa, Calif. 95405

[21] Appl. No.: 924,288

[22] Filed: Oct. 29, 1986

[51] Int. Cl.[4] ..... B03C 1/02

[52] U.S. Cl. ..... 209/8; 209/214; 209/223.1; 209/229; 209/549; 324/326

[58] Field of Search ..... 209/8, 1 R, 38, 213, 209/214, 215, 216, 223.1, 228, 229, 549, 555, 557, 558; 324/326, 354, 62 R, 65 P

[56] References Cited

U.S. PATENT DOCUMENTS

| | | | |
|---|---|---|---|
| 412,924 | 10/1889 | Kester | 324/326 |
| 1,885,717 | 11/1932 | Harris | 209/12 |
| 2,636,917 | 4/1953 | Law | 324/65 P |
| 2,792,115 | 5/1957 | Medearis | 209/223.1 |
| 4,017,386 | 4/1977 | Barry | 209/215 |

*Primary Examiner*—Robert B. Reeves
*Assistant Examiner*—Donald T. Hajec
*Attorney, Agent, or Firm*—Flehr, Hohbach, Test, Albritton & Herbert

[57] ABSTRACT

A metal scavenging device is disclosed which includes a frame carrying a plurality of generally parallel spaced-apart scavenger elements. In one embodiment the elements are comprised of flat plates having parallel walls. In another embodiment the elements are comprised of plates having inclined walls with the walls adjacent plates forming V-shaped spaces. In another embodiment the elements are comprised of elongate cylinders. A control circuit is provided to apply electrical charges of opposite polarities to adjacent plates. The circuit is closed when metal bodies contact adjacent surfaces of the plates. Current flow through the bodies creates a magnetic field, and strong permanent magnets provide a flux attracting the field about the bodies which are wedged and captured between the plates. The circuit includes a normally closed circuit breaker switch together with an indicator bulb which provides a visual signal when a metal body makes contact between the plates.

12 Claims, 6 Drawing Figures

DEVICE FOR SCAVENGING METAL FROM EARTH DEPOSITS

This invention relates to the recovery of ferrous and non-ferrous metals from sand and earth deposits. In particular, the invention relates to scavenging metal bodies such as gold, silver and other metals from loose sand and earth in above-ground as well as submerged deposits.

Various types of conventional mining apparatus have been developed to recover minerals from sand and earth deposits. Apparatus of this type are commonly employed in the mining of precious metals such as gold and silver. Among the conventional apparatus are those employing gravity separation such as sluice boxes in which heavy metals such as gold nuggets are separated by the action of gravity from a stream of water and sand. Gold mining pans also employ this principle. The sluice boxes are not readily portable and require substantial amounts of water for operation such that their use is infeasible away from a stream or other source of water. The use of gold mining pans similarly is restricted to use in an area where there is a source of plentiful water.

It is an object of the present invention to provide a new and improved metal scavenging device for use in above-ground as well as submerged sand and earth deposits.

Another object is to provide a metal scavenging device which is portable and is adapted to be carried and operated by a single individual.

Another object is to provide a device of the type described which recovers both ferrous and non-ferrous metal bodies of varied particle size from loose sand and earth deposits.

Another object is to provide a device for scavenging metal bodies without requiring large volumes of water.

The invention in summary provides a metal scavenging device having a frame carrying a plurality of generally parallel spaced-apart scavenger elements. A control circuit is provided for applying an electrical charge to the elements such that adjacent elements have opposite polarities. The frame can be moved to push the elements through the metal bearing deposits, or the frame can be held stationary with the deposits poured down and around the elements. Metal bodies such as nuggets carried by the deposits bridge across adjacent elements closing an electrical path for the flow of direct current across the bodies. The current flow establishes a magnetic field about the bodies, and permanent magnets mounted in the frame attract the field and capture the bodies between the elements. The frame and elements are then withdrawn from the deposits and the current interrupted to release the bodies so that they can be removed.

The foregoing and additional objects and features of the invention will appear from the following specification in which the several embodiments have been set forth in conjunction with the accompanying drawings.

Figure 1:
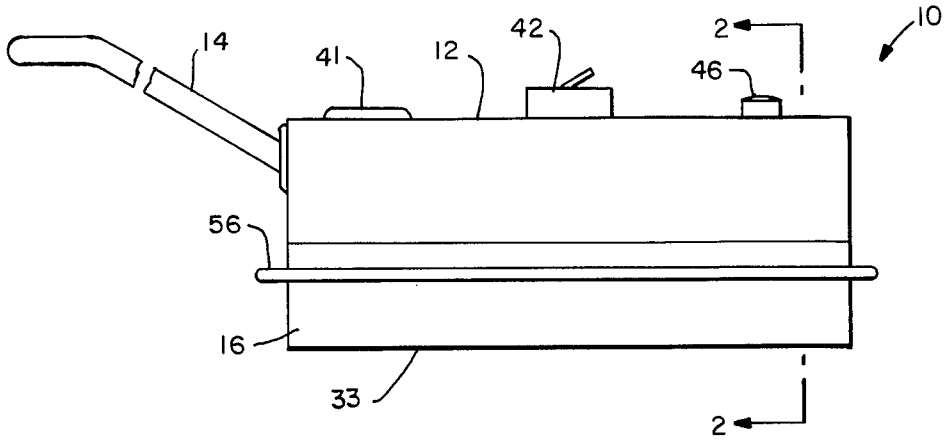
FIG. 1 is a side view of a scavenging device in accordance with one embodiment of the invention.
Figure 2:
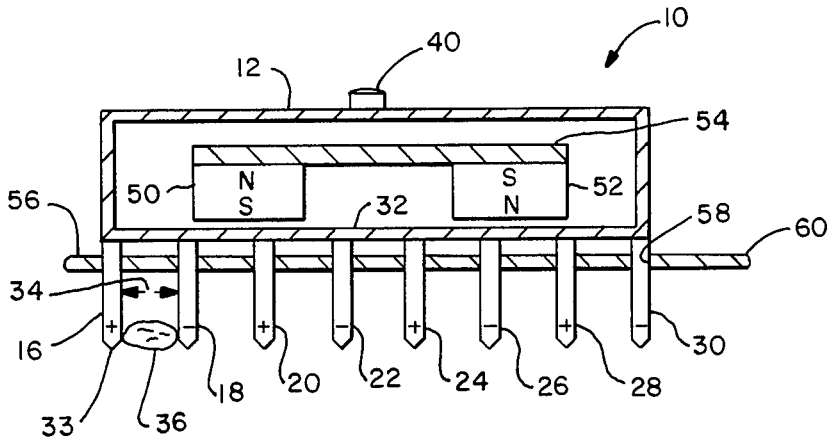
FIG. 2 is a cross-sectional view taken along the line 2—2 of FIG. 1.
Figure 3:
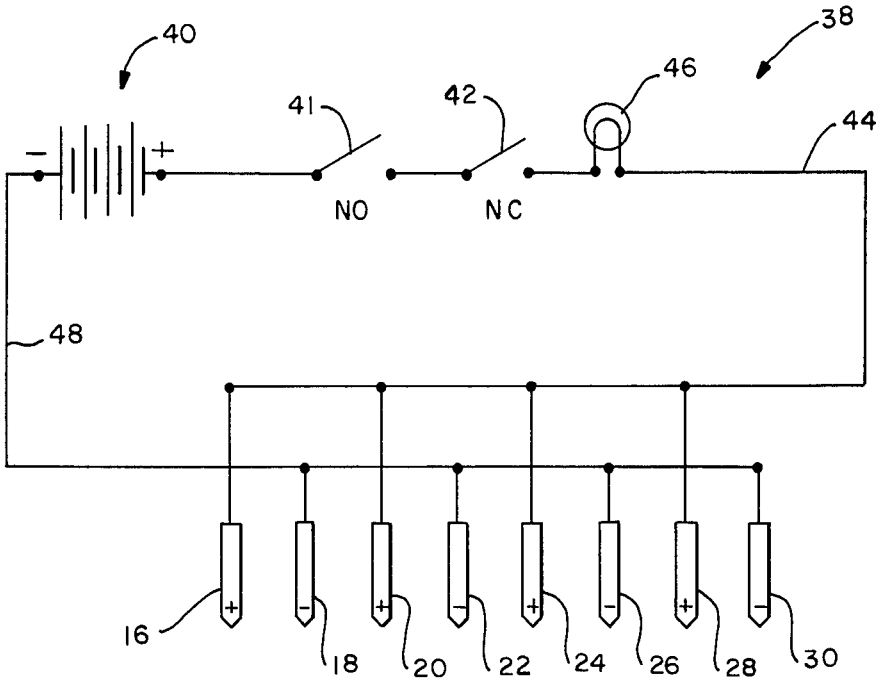
FIG. 3 is a schematic diagram of the control circuit for the embodiment of FIG. 1.

In the drawings FIGS. 1–3 illustrate a metal scavenging device 10 in accordance with one preferred embodiment of the invention. Device 10 is comprised of a box-shaped frame 12 having a handle 14 attached to and extending outwardly from one end. A plurality of generally parallel, spaced-apart scavenger elements 16–30 are mounted on and extend outwardly from the bottom side 32 of the frame. In this embodiment each element is in the form of a flat plate with parallel side walls. The distal ends of the plates taper toward points 33 which facilitate penetration downwardly into loose sand and earth.

The outer surface layers of elements 16–30 are comprised of a suitable electrical conductive material and preferably the layer material is selected from the group consisting of Al, Cu, Ag and Au. Preferably the softer metals such as Cu and Au are alloyed and plated on the surfaces to provide hardness and durability and to improve contact of metal specimens on the elements. The elements could also be formed entirely of the conductive material, as desired.

The lateral spacing 34 between adjacent elements is predetermined in accordance with the approximate width of the metal bodies or nuggets, typically shown at 36, which are to be scavenged from the sand or earth deposits. For example, a spacing between the elements in the range of 0.005" to 1.000" can be employed. By using 0.005" to 0.010" spacing gold dust can be trapped between the elements by pouring sand over and down through the elements.

Device 10 includes electrical control means comprising the circuit 38 schematically depicted in FIG. 3. A direct current source of power comprising the preferred battery 40 having a voltage of, for example, 24 V is mounted within frame 12. A normally open on-off switch 41 and a normally closed circuit breaker switch 42 are connected in series with the positive terminal of the battery. The switch 42 is connected with a conductor 44 which is in parallel connection with alternate ones of the scavenger elements 16, 20, 24 and 28. An indicator bulb 46 is connected in series with conductor 44 to provide a visual light signal responsive to a flow of current through the conductor. The negative side of the battery leads through a conductor 48 in parallel connection with the elements 18, 22, 26 and 30 which are positioned alternately between the elements connected to the positive side of the battery. An AC-DC converter, not shown, can be provided for charging the battery from an AC power source. As desired the electrical control means could also be incorporated into a separate housing connected to frame 12 by a suitable cable.

In the case where device 10 is to be used underwater such as in submerged stream beds, the frame is sealed watertight to protect the control circuit.

Magnet means comprising a pair of strong permanent magnets 50, 52 are mounted on a flat bar 54 of soft steel carried within the frame. The magnets are mounted with their ends which face the scavenger elements having opposite polarities. Thus, the bottom end of magnet 50 has a south polarity while the bottom end of magnet 52 has a north polarity. Preferably the magnets are of Neodymium, Alnicol, Samarium Cobalt or ceramic materials which produce very strong magnetic fluxes. The two magnets are mounted on the bar 54 at opposite ends of the frame to produce a strong magnetic flux which extends across the volume occupied by the scavenger elements.

A platen 56 is provided for removing residual sand and earth material that may be lodged between the plates. Platen 56 is formed with a plurality of apertures 58 which are aligned with and sized commensurate with respective elements 16–30. A handle 60 is provided at one end of the platen for moving it up and down along the length of the plates.

Figure 4:
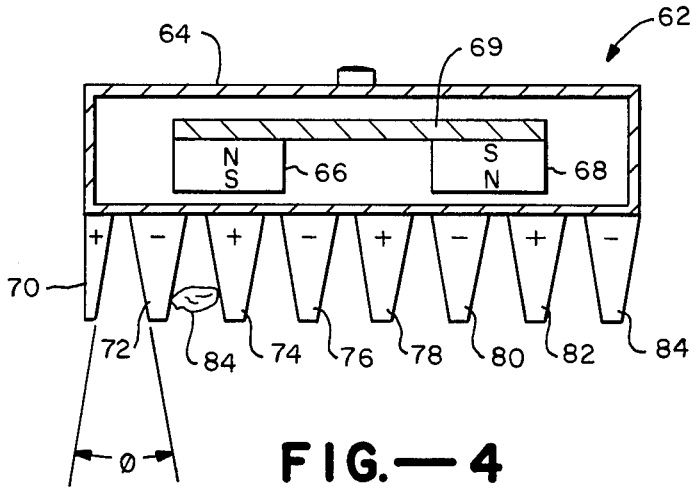
FIG. 4 is a cross-sectional view of another embodiment of the invention.

FIG. 4 illustrates another embodiment of the invention providing metal scavenging device 62 having scavenger elements of a wedge shape. Device 62 includes a box-shaped frame 64 which carries a pair of permanent magnets 66, 68 on a bar 69 as well as control circuit means similar in operation to that described for the embodiment of FIGS. 1–3.

In the embodiment of FIG. 4 the scavenger elements 70–82 are comprised of a plurality of generally parallel, spaced-apart plates having flat walls which extend at angles converging toward their distal ends. The included angle $\phi$ which forms a V-shaped space between the facing walls is preferably in the range of 15°–25°, and in the example illustrated the angle $\phi$ is 20°. The plates can be formed with surface layers of a conductive material as described for the embodiment of FIGS. 1–3, or the plates could be integrally formed of the conductive material. The V-shaped spaces between adjacent plates receive the sand and earth deposits and act to wedge metal bodies, typically shown at 84, of varying diameters which are carried in the deposits.

Figure 5:
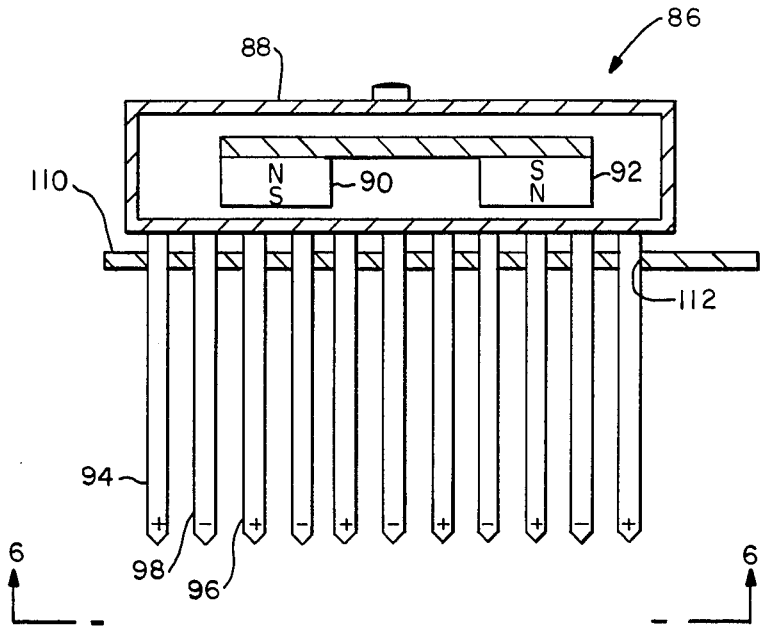
FIG. 5 is a cross-sectional view of another embodiment of the invention.
Figure 6:
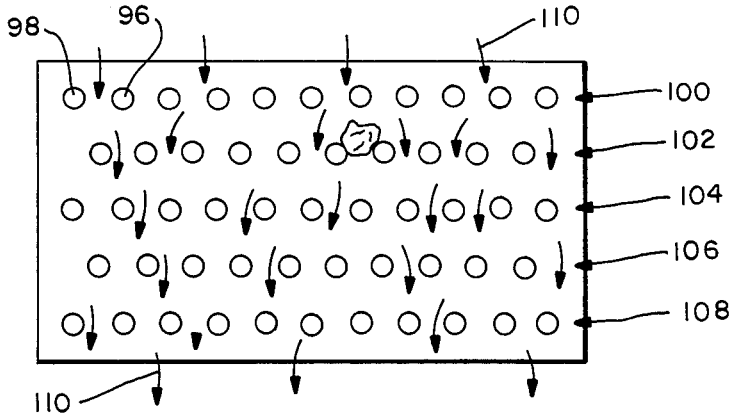
FIG. 6 is a bottom plan view taken along the line 6—6 of FIG. 5.

FIGS. 5 and 6 illustrate another embodiment of the invention providing a metal scavenging device 86 having elements of cylindrical shape. Device 86 is comprised of a box-shaped frame 88 which carries a pair of strong permanent magnets 90, 92 and control circuit means similar in operation to that described for the embodiment of FIGS. 1–3.

Scavenger elements 94–96 of device 86 comprise a plurality of elongate cylinders or rods having tapered distal ends 98. As best shown in FIG. 6 the rods are mounted in a plurality, shown as five, of rows 100–108 with the rods in each row being staggered from the rods in adjacent rows. The staggered positioning of the rods improves the distribution of sand and earth being poured down and around the rods in a manner to be subsequently explained. The rods are formed with surface layers of the electrical conductive material as described for the embodiment of FIGS. 1–3, or the rods could be integrally formed of the conductive material.

A platen 110 is provided with a plurality of apertures 112 aligned with and sized commensurate with the scavenger rods. The platen is adapted for back-and-forth movement along the rods to remove residual sand and earth deposits.

The use and operation of the invention will be explained in relation to the embodiment of FIGS. 1–3 in a method for scavenging precious metal bodies such as gold nuggets from loose sand or earth deposits in the ground or in submerged river or stream beds. Control circuit 38 is energized by closing switch 41 with the battery applying electrical charges of opposite polarities to adjacent plate elements 16–30. The device is carried over the ground area to be explored and pushed down so that the plates penetrate the loose sand and earth. Handle 14 can be employed to push frame 12 forward and thereby push the plates along a path through the loose deposits. As the device moves forward gold nuggets or other metal bodies will be carried with the deposits between the plates. Opposite ends of metal bodies commensurate with the spacing between the plates will contact the surfaces of adjacent plates so that a conductive path is formed to close the electrical circuit. This is exemplified by the body 36 which is shown in contact between the plates 16 and 18 in FIG. 2. The voltage potential of the battery causes electrical current to flow across the body with the current establishing a magnetic field about the body. The strong flux from the permanent magnets 50 and 52 attracts the magnetic field about the bodies which are pulled upwardly to contact and firmly wedge between the plates. This action captures the bodies between the plates as long as the circuit is closed.

When metal bodies contact the plate and close the circuit the indicator bulb 46 responds to the flow of current to operate and provide a visual signal to the operator. Upon thereby being alerted that a metal body has been captured, the operator withdraws device 10 from the ground and actuates switch 42 to open the circuit. This shuts off the current flow as well as the magnetic field about body 36, and collapse of the magnetic field terminates the force of attraction with the permanent magnets. The operator can then remove the metal body from between the plates by using a separate tool or stick or by moving the platen 56 downwardly along the length of the plates. After removal of the metal body switch 42 is closed by the operator to reset the device for another cycle of movement through the deposits.

The scavenger devices 10, 62 and 86 of the three embodiments described can also be used by holding the frames stationary with the plates or rods, as the case may be, horizontally positioned for pouring loose sand and gravel deposits downwardly about the elements. For example, device 86 of FIG. 5 is mounted with its frame 88 stationary and with rods 94–96 extending horizontally. The loose sand and earth deposits are then poured downwardly from the top with the flow dispersing around the rods in direction of the arrows 110 shown in FIG. 6. Metal bodies of a size commensurate with the gaps between the rods are captured in the manner described above and the remaining sand and earth falls downwardly from the last row of rods.

While the foregoing embodiments are at present considered to be preferred it is understood that numerous variations and modifications may be made therein by those skilled in the art and it is intended to include in the accompanying claims all such variations and modifications that fall within the spirit and scope of the invention.

What is claimed is:

1. A device for scavenging ferrous and non-ferrous metal bodies from above-ground and submerged metal-bearing sand and earth deposits, the device comprising the combination of a frame, a plurality of generally parallel, spaced-apart scavenger elements mounted on and extending outwardly from at least one side of the frame, the elements having surfaces comprised of an electrical conductive material, control circuit means for applying an electrical charge to the elements with the facing surfaces of adjacent elements having opposite polarities and with metal bodies contained in the deposits bridging across and contacting the surfaces of adjacent elements to create electrical paths across the bodies for the flow of direct current with the current establishing magnetic fields about the bodies, and magnet means in the frame for attracting the magnetic fields and capturing the bodies between the elements.

2. A device as in claim 1 in which the elements are comprised of plates having flat walls which form the facing surfaces.

3. A device as in claim 2 in which the flat walls of each plate are parallel.

4. A device as in claim 2 in which the flat walls of each plate extend at angles which converge toward the distal ends of the plates with the facing surfaces of adjacent plates forming V-shape gaps for wedging the bodies when the magnet means attracts the magnetic fields about the bodies.

5. A device as in claim 1 in which the elements comprise elongate cylinders.

6. A device as in claim 1 in which the control circuit means includes indicator means for establishing a visual signal responsive to the flow of current across the bodies captured between the elements.

7. A device as in claim 6 in which the control circuit means includes manually-operated switch means for interrupting the flow of current for deactivating the magnetic field about the bodies and permitting removal of the bodies from between the elements.

8. A device as in claim 1 in which the conductive material of the surfaces of the elements is selected from the group consisting of Al, Cu, Ag and Au.

9. A device as in claim 1 which includes a platen having a plurality of apertures aligned with respective elements and with the apertures commensurate in size with the elements, the platen being mounted for movement along the length of the elements for removal of residual sand and earth deposits lodged between the elements.

10. A method for scavenging ferrous and non-ferrous metal bodies from above-ground and submerged metal-bearing sand and earth deposits comprising the steps of disposing a plurality of generally parallel, spaced-apart elements through the deposits, applying electrical charges to the elements with the facing surfaces of adjacent elements having opposite polarities, causing a metal body within the deposits to make electrical contact with the surfaces of adjacent elements, directing a flow of direct current between the adjacent elements across said body with the flow of current establishing a magnetic field about the body, and creating a magnetic field at one end of the elements which attracts the magnetic field about the body to capture and hold the body between the elements.

11. A method as in claim 10 in which the sand and earth deposits are stationary and the elements are moved along a path through the deposits while said electrical charges are being applied to the elements.

12. A device as in claim 10 in which the elements are stationary and the sand and earth deposits are caused to flow through and between the elements while said electrical charges are being applied.

* * * * *